US006445269B1

(12) United States Patent
Sylvain et al.

(10) Patent No.: US 6,445,269 B1
(45) Date of Patent: Sep. 3, 2002

(54) DRY-TYPE HIGH-VOLTAGE WINDING

(75) Inventors: Laureote Sylvain, Fontainebleau (FR); Dominique Feldmann, Veneux les Sablons (FR); Michel Sacotte, Rombas (FR); Jacques Wild, Metz (FR); Lana Sheer, Kennett Square, PA (US); Albert P. Walrave, Butzbach (DE); Max-André Mounoud, La Celle-les-Bordes (FR)

(73) Assignees: E.I. du Pont de Nemours and Company, Wilmington, DE (US); Electricite de France-Service National, Paris (FR); Schneider Electric S.A., Boulogne Billancourt (FR)

( * ) Notice: Subject to any disclaimer, the term of this patent is extended or adjusted under 35 U.S.C. 154(b) by 0 days.

(21) Appl. No.: 09/254,021

(22) PCT Filed: Sep. 4, 1996

(86) PCT No.: PCT/FR96/01356

§ 371 (c)(1),
(2), (4) Date: Oct. 28, 1999

(87) PCT Pub. No.: WO98/10446

PCT Pub. Date: Mar. 12, 1998

(51) Int. Cl.[7] ..... H01F 27/36

(52) U.S. Cl. ..... 336/84 R; 336/69; 336/84 C; 336/96

(58) Field of Search ..... 336/84 R, 69, 336/206, 90, 84 C, 96; 428/36.1; 310/45

(56) References Cited

U.S. PATENT DOCUMENTS

| | | | | |
|---|---|---|---|---|
| 3,045,290 A | | 7/1962 | Anderson et al. | |
| 4,008,409 A | * | 2/1977 | Rhudy et al. | 310/45 |
| 4,137,515 A | * | 1/1979 | Akao et al. | 336/84 C |
| 4,543,555 A | * | 9/1985 | McDermott | 336/206 |
| 4,586,015 A | * | 4/1986 | Takahara et al. | 336/84 |
| 4,944,975 A | * | 7/1990 | Sheer | 428/36.1 |

OTHER PUBLICATIONS

Patent Abstracts of Japan, vol. 18, No. 527 (E–1613) Oct. 5, 1994 & JP 06 188130, Jul. 8, 1994.
Patent Abstracts of Japan, vol. 6, No. 025 (E–094), Feb. 13, 1982 & JP 56 146211, Nov. 13, 1981.

* cited by examiner

*Primary Examiner*—Lincoln Donovan
*Assistant Examiner*—Tuyen T. Nguyen
(74) *Attorney, Agent, or Firm*—Sughrue Mion, PLLC

(57) ABSTRACT

The invention concerns an air-core primary voltage winding comprising a conductive wire coil coated with an insulating sheath, characterized in that said coil (1) is encapsulated in a high voltage insulating thermoplastic resin (2), and in that it further comprises an electroconductive potential fixing surface layer (3) in thermoplastic resin compatible with the thermoplastic resin of the insulating encapsulation (2), deposited on this encapsulation.

16 Claims, 1 Drawing Sheet

DRY-TYPE HIGH-VOLTAGE WINDING

BACKGROUND OF THE INVENTION

The present invention concerns high-voltage windings and more particularly windings of this type that can be used as dry transformer high-voltage windings.

High-voltage windings for such applications must be able to withstand voltages in the range 5 kV to 36 kV.

SUMMARY OF THE INVENTION

Solid insulation transformers or dry transformers are known per se in which the windings are coated with heat-setting insulative materials and which have sizeable airgaps assuring an insulation function between windings and between windings and the electrical earth, which increase their overall size, their mass and consequently their cost.

To overcome this problem some manufacturers use surface metallisation of the windings to reduce the overall size of the equipment.

However, this technique has the drawback of being costly and difficult to implement.

Currently there are two major families of dry transformers. Coated transformers and impregnated transformers. The methods of manufacturing these devices are certainly different, but the insulating materials used have the common features of being heat-setting and of requiring polymerisation at raised temperature, leading to high manufacturing cost.

The invention aims to reduce the aforementioned drawbacks of dry insulation devices by creating a high-voltage winding which combines performance at least as good as that of dry insulating arrangements known per se with a low manufacturing cost and enhanced operational safety.

It therefore consists in a high-voltage winding comprising a winding of conductive wire coated with an insulative sheath characterised in that said winding is coated with a high-voltage insulative thermoplastics resin and in that it further comprises a potential fixing electroconductive surface layer of a thermoplastics resin compatible with the thermoplastics resin of the insulative coating deposited on that coating.

In accordance with other features of the invention:

- the winding includes a lateral strip of insulative thermoplastics resin compatible with the insulative material of the coating of the winding, of increased thickness relative thereto and covering the connecting conductors of the winding and orifices are formed in the insulative coating and in the covering strip for the ends of the connecting conductors so that they can be connected to other components;
- the resin of the insulative coating is selected from the group comprising 6—6 polyamides, 6-polyamides, 4,6-polyamides, 12,12 polyamides, 6–12 polyamides, polyamides containing aromatic monomers, polybutylene terephthalate, polypropylene terephthalate, polyethylene naphthalate, liquid crystal polymers, polycyclohexane dimethylol terephthalate, copolyether esters, polyphenylene sulphide, polyacylics, polypropylene, polyethylene, polyacetals, polymethylpentene, polyether imides, polycarbonates, polysulphones, polyethersulphones, polyphenylene oxides, polystyrene, styrene copolymers, mixtures and grafted copolymers of styrene and rubber and mixtures of the above substances;
- the thermoplastics resin of the insulative coating is polyethylene terephthalate;

- the polyethylene terephthalate is charged with glass fibres;
- the thickness of the thermoplastics resin of the insulative coating is in the range 3 mm to 50 mm;
- the electroconductive thermoplastics resin of the potential fixing layer contains a charge of carbon;
- the winding-constitutes the high-voltage winding of a dry transformer.

The invention also consists in a method of producing a high-voltage winding, characterised in that it consists in:

- winding a conductive wire coated with an electro-insulative sheath to form a hollow cylindrical winding;
- in a first mould, moulding a first coating of the winding in an electrically insulative thermoplastics resin to obtain a layer of electrically insulative thermoplastics resin of sufficient thickness for the winding to be insulated from the exterior, and
- in a second mould, moulding onto the winding complete with its electrically insulative thermoplastics resin layer a second coating in the form of a potential fixing electroconductive thermoplastics resin layer.

In accordance with other features of the invention, the coating phase in the first mould consists in:

- placing the winding in the cavity of a mould having an inlet, a vent orifice and rods for supporting an object inside the mould;
- moving the rods into contact with the winding to support it in the cavity;
- injecting the electrically insulative thermoplastics resin into the mould through its inlet;
- withdrawing the rods out of the cavity when the thermoplastics resin is injected into the cavity before it sets around the rods to prevent the formation of voids in the electrically insulative thermoplastics resin;
- allowing air to exit the cavity through the vent orifice when the resin fills the mould, and
- continuing to inject the electrically insulative thermoplastics resin until the mould is filled to form an electrically insulative thermoplastics resin layer that is practically free of voids and of sufficient thickness for the winding to be insulated from the outside;
- injection of the electrically insulative thermoplastics resin is continued until a uniform thickness of at least 3 mm is obtained on the outside and inside diameters of the winding and a uniform thickness of at least 2.5 mm is obtained at the axial ends of the winding;
- the second coating with the electroconductive thermoplastics resin layer is performed by hot compression moulding.

BRIEF DESCRIPTION OF THE DRAWINGS

The invention will be better understood on reading the following description given by way of example only and with reference to the accompanying drawings, in which.

DETAILED DESCRIPTION OF THE DRAWINGS

Figure 1:
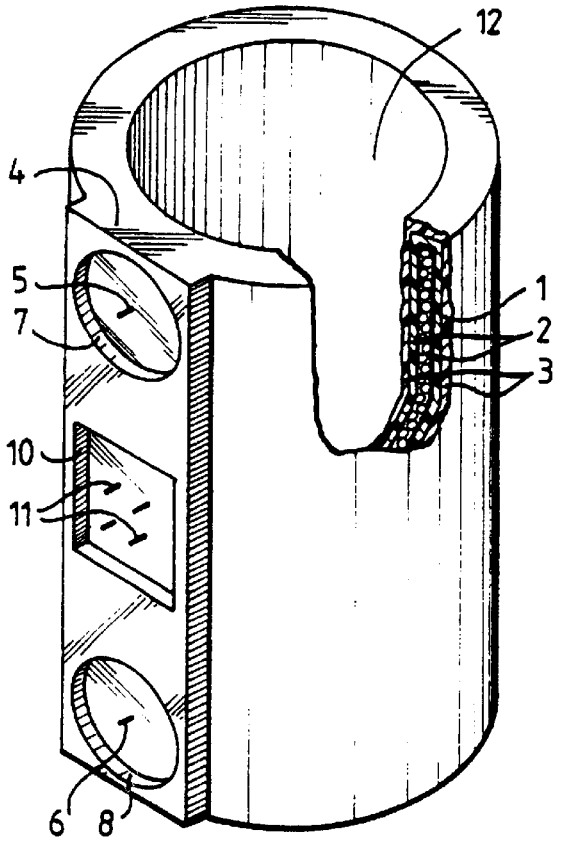
FIG. 1 is a partly cut-away perspective view of a high-voltage winding in accordance with the invention.

The winding shown in the drawings is a high-voltage winding that can in particular be used as the high-voltage winding of a dry transformer.

It mainly comprises a winding 1 of conductive wire covered with an insulative sheath. The winding 1 is coated with a high-voltage insulative thermoplastics resin 2.

The thermoplastics resin used for this coating is advantageously polyethylene terephthalate, optionally loaded with reinforcing glass fibres.

The resin can equally be selected from the group comprising 6—6 polyamides, 6-polyamides, 4,6-polyamides, 12,12 polyamides, 6–12 polyamides, polyamides containing aromatic monomers, polybutylene terephthalate, polypropylene terephthalate, polyethylene naphtalate, liquid crystal polymers, polycyclohexane dimethylol terephthalate, copolyether esters, polyphenylene sulphide, polyacylics, polypropylene, polyethylene, polyacetals, polymethylpentene, polyether imides, polycarbonates, polysulphones, polyethersulphones, polyphenylene oxides, polystyrene, styrene copolymers, mixtures and grafted copolymers of styrene and rubber and mixtures of the above substances.

The thickness of the thermoplastics resin of the insulative coating 2 can be in the range 3 mm to 50 mm.

On top of the insulative resin coating 2 is deposited a surface electroconductive layer 3 for fixing the potential and formed of a thermoplastics resin compatible with the thermoplastics resin of the insulative coating 2.

The potential fixing thermoplastics resin 3 advantageously contains a charge of carbon.

The insulative coating 2 includes a lateral strip 4 of insulative thermoplastics resin compatible with the insulative material of the coating, possibly the same material as the coating.

The lateral strip is disposed axially to form an increased thickness relative to the coating 2. It covers the connecting conductors 5, 6 of the winding and the internal connections of the winding. Respective orifices 7, 8 around the conductors 5 and 6 are formed in the insulative coating 2 and in the covering strip 4 to provide a passage for the ends of the connecting conductors 5, 6 so that they can be connected to other components, not shown.

Between the two openings 7, 8 for the connecting conductors 5, 6 is an additional opening 10 into which project conductors 11 constituting intermediate terminals of the winding 1 and which can be connected by jumpers, not shown, to adapt the winding to suit the application.

The lateral strip 4 of insulative thermoplastics resin is also covered with the potential fixing electroconductive surface layer 3 except at the orifices 7, 8, 10.

The orifices 7 and 8 for the connecting conductors of the winding are adapted to cooperate with insulative members, not shown, surrounding the ends of connecting busbars, for example, and provide continuity of the coating and of the potential fixing electroconductive layer.

The intermediate orifice 10 for access to the conductors 11 for adjusting the winding is advantageously closed off by a plug of insulative material (not shown) coated with an electroconductive layer to assure continuity with the electroconductive layer 3 covering the whole of the winding.

Figure 2:
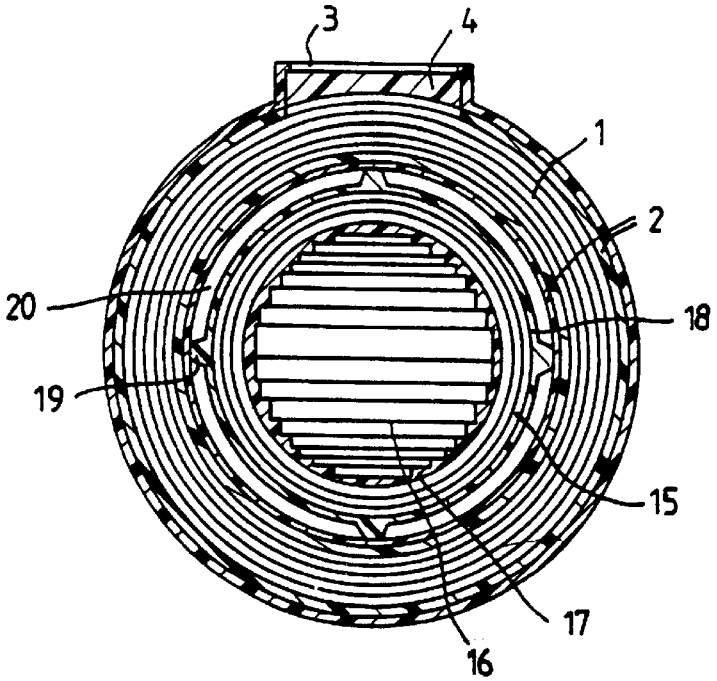
FIG. 2 is a cross-section of a dry transformer in which the high-voltage winding is formed by the highvoltage winding from FIG. 1.

FIG. 2 shows that the insulative thermoplastics resin coating 2 surrounds both the outside contour and the inside contour of the hollow cylindrical winding 1.

This figure also shows clearly that the strip 4 covering the connecting conductors of the winding is also covered by the potential fixing electroconductive surface layer 3.

The resulting annular high-voltage winding lends itself particularly well to application as the high-voltage winding of a dry transformer.

Its interior space 12 can receive a low-voltage winding mounted on a magnetic circuit column, not shown.

As shown clearly in FIG. 2, the high-voltage winding in accordance with the invention constitutes the high-voltage winding of a dry transformer.

The high-voltage winding 1 is associated with a low-voltage winding 15 which is also dry insulated and is mounted on a laminated magnetic circuit column 16 with a sleeve 17 between them. The low-voltage winding 15 is coated in a material 18 such as a thermoplastics resin, for example, and has at its periphery axial ribs 19 moulded into it which define, on coming into contact with the inside surface of the electroconductive resin coating 3 of the high-voltage winding 1, a passage 20 for a cooling fluid such as air to flow in.

To produce the high-voltage winding in accordance with the invention described with reference to FIGS. 1 and 2, the first step is to wind a conductive wire coated with an electro-insulative sheath to form the hollow cylindrical winding 1.

In a first mould, not shown, a first coating of the winding 1 is moulded from an electrically insulative thermoplastics resin of sufficient thickness for the winding to be electrically insulated from the exterior.

In a second mould, not shown, a second coating is moulded onto the winding complete with its electrically insulative thermoplastics resin coating 2, in the form of a potential fixing electroconductive thermoplastics resin layer 3.

For coating in the first mould, the winding 1 is placed in the cavity of the aforementioned mould which has an inlet, a vent opening and rods for supporting an object inside the mould.

The support rods are moved until they come into contact with the winding 1 in order to support it inside the mould cavity.

The resin is preheated to a temperature at which the resin flows in a chamber provided with an injector screw.

The electrically insulative thermoplastics resin is injected at high pressure into the relatively cold mould through its inlet. The high pressure can be applied hydraulically or pneumatically. The pressure at which the resin is injected can be in the range 35 MPa to 138 MPa and the temperature in the range approximately 200° C. to approximately 400° C. The support rods are withdrawn from the mould cavity when the thermoplastics resin is injected into the cavity and before it sets around them, in order to prevent the formation of voids in the electrically insulative thermoplastics resin.

During this operation air is allowed to exit the mould cavity through the vent orifice as the resin fills the mould. The vent orifice can be in the form of a plurality of holes in the region where the radial surface and the axial surfaces of the mould join.

The first mould is constructed so that the molten resin enters the mould through a circumferential inlet in the inside surface of the mould.

The electrically insulative thermoplastics resin continues to be injected until the mould is filled to form a layer of electrically insulative thermoplastics resin 2 that is practically free of voids and of sufficient thickness for the winding to be insulated from the exterior.

Injection of the electrically insulative thermoplastics resin is advantageously continued until a uniform thickness of at least 3 mm of insulative coating is obtained on the inside and outside diameters of the winding 1 and a uniform thickness of at least 2.5 mm of insulative coating is obtained at the axial ends of the winding.

The winding with its insulative coating 2 is then removed from the first mould and tested to ensure that the coating 2 is free of voids.

This test can be conducted by any conventional method, such as using x-rays or by measuring partial discharges caused by voids when the winding is energised.

The expression "practically free of voids" as used herein means that the voids are invisible using an electron microscope set to a magnification of ×1000.

After completing the coating operation using electrically insulative thermoplastics material in the first mould, during which it is also possible to form the lateral strip 4 covering the connecting conductors 5, 6 of the winding, the orifices 7 and 8 around the ends of these conductors and the intermediate orifice 10 for the conductors 11 for adjusting the winding, the product obtained is placed in a second mould, not shown, in which a hot compression moulding process is used to apply over the insulative thermoplastics material coating a second coating in the form of a layer of electroconductive thermoplastics resin to obtain the potential fixing surface layer 3 of the high-voltage winding.

It is equally possible to add the lateral strip 4 of insulative thermoplastics material by hot compression before applying the electroconductive thermoplastics resin.

What is claimed is:

1. High-voltage winding comprising a hollow cylindrical winding made of conductive wire, the conductive wire being coated with an insulative sheath and having connecting conductors having ends, said hollow cylindrical winding ofconductive wire being coated with a high-voltage insulative thermoplastics resin which surrounds both the outside contour and the inside contour of the hollow cylindrical winding, a lateral strip covering the high-voltage insulative thermoplastics resin, the lateral strip being disposed axially relative to the high-voltage insulative thermoplastics resin, the lateral strip being made of an insulative thermoplastics resin compatible with the high-voltage insulative thermoplastics resin, the lateral strip and the high-voltage insulative thermoplastics resin forming an increased thickness relative to the high-voltage insulative thermoplastics resin, the lateral strip covering the connecting conductors of the hollow cylindrical winding, orifices being formed in the high-voltage insulative thermoplastics resin and in the lateral strip to provide a passage for said ends of said connecting conductors; a potential fixing electroconductive surface layer being deposited on the whole of the high-voltage insulative resin and of the lateral strip, except at said orifices, said potential fixing electroconductive surface layer being made of a thermoplastics resin compatible with the high-voltage insulative thermoplastics resin.

2. High-voltage winding according to claim 1 characterised in that the resin of the insulative coating is selected from the group comprising 6—6 polyamides, 6-polyamides, 4,6-polyamides, 12,12 polyamides, 6–12 polyamides, polyamides containing aromatic monomers, polybutylene terephthalate, polypropylene terephthalate, polyethylene naphtalate, liquid crystal polymers, polycyclohexane dimethylol terephthalate, copolyether esters, polyphenylene sulphide, polyacylics, polypropylene, polyethylene, polyacetals, polymethylpentene, polyetherimides, polycarbonates, polysulphones, polyethersulphones, polyphenylene oxides, polystyrene, styrene copolymers, mixtures and grafted copolymers of styrene and rubber and mixtures of the above substances.

3. Winding according to claim 1, characterised in that the thermoplastics resin of the insulative coating is polyethylene terephthalate.

4. Winding according to claim 3, characterised in that the polyethylene terephthalate is charged with glass fibres.

5. Winding according to claim 1, characterised in that the thickness of the thermoplastics resin of the insulative coating is in the range 3 mm to 50 mm.

6. High-voltage winding according to claim 1, characterised in that electroconductive thermoplastics resin of the potential fixing layer contains a charge of carbon.

7. Winding according to claim 1, characterised in that the electroconductive resin is selected from the same materials as the resin of the insulative coating and in that it further contains 20% to 70% of carbon particles.

8. High-voltage winding according to claim 1, characterised in that it constitutes the high-voltage winding of a dry transformer.

9. High-voltage winding according to claim 1, characterised in that the hollow cylindrical winding has an interior space formed by the inside surface of the potential fixing electroconductive surface layer, a low-voltage winding mounted on a magnetic circuit column being received in said interior space.

10. High-voltage winding according to claim 9, characterised in that said lowvoltage winding is coated in a thermoplastics resin and has at its periphery axial ribs coming into contact with the inside surface of the potential fixing electroconductive surface layer of the high-voltage winding.

11. High-voltage winding according to claim 10, characterised in that said axial ribs define with said inside surface of the potential fixing electroconductive surface layer of the high-voltage winding a passage for a cooling fluid to flow in.

12. Method of producing a high-voltage winding according to claim 1, characterised in that it comprises:

winding a conductive wire coated with an electroinsulative sheath to form a hollow cylindrical winding (1);

in a first mould, moulding a first coating of the winding in an electrically insulative thermoplastics resin to obtain a layer (2) of electrically insulative thermoplastics resin of sufficient thickness for the winding to be insulated from the exterior, and in a second mould, moulding onto the winding complete with its electrically insulative thermoplastics resin layer a second coating in the form of a potential fixing electroconductive thermoplastics resin layer (3).

13. Method according to claim 12, characterised in that the coating phase in the first mould comprises:

placing the winding (1) in the cavity of a mould having an inlet, a vent orifice and rods for supporting an object inside the mould, moving the rods into contact with the winding to support it in the cavity, injecting the electrically insulative thermoplastics resin into the mould through its inlet, withdrawing the rods out of the cavity when the thermoplastics resin is injected into the cavity before it sets around the rods to prevent the formation of voids in the electrically insulative thermoplastics resin, allowing air to exit the cavity through the vent orifice when the resin fills the mould, and continuing to inject the electrically insulative thermoplastics resin until the mould is filled to form an electrically insulative thermoplastics resin layer (2) that is practically free of voids and of sufficient thickness for the winding to be insulated from the outside.

14. Method according to claim 13, characterised in that injection of the electrically insulative thermoplastics resin is continued until a uniform thickness of at least 3 mm is obtained on the outside and inside diameters of the winding and a uniform thickness of at least 2.5 mm is obtained at the axial ends of the winding.

15. Method according to claim 13, characterised in that the insulative thermoplastics resin lateral strip (4) is obtained by hot compression on the insulative coating before application of the electroconductive covering (3).

16. Method according to claim 12, characterised in that the second coating with the electroconductive thermoplastics resin layer (3) is performed by hot compression moulding.

* * * * *

UNITED STATES PATENT AND TRADEMARK OFFICE

CERTIFICATE OF CORRECTION

PATENT NO. : 6,445,269 B1
DATED : September 3, 2002
INVENTOR(S) : Sylvain Laureote et al.

It is certified that error appears in the above-identified patent and that said Letters Patent is hereby corrected as shown below:

Title page,
Item [75], Inventors, the first named inventor should read
-- Sylvain Laureote --;
Item [73], Assignee, should read as follows:
-- Schneider Electric S.A., Boulogne (FR); Electricite de France Service National, Paris (FR) --.

Signed and Sealed this

Fifteenth Day of April, 2003

JAMES E. ROGAN
*Director of the United States Patent and Trademark Office*